US005273023A

United States Patent [19]

Ebbeson

[11] Patent Number: 5,273,023

[45] Date of Patent: Dec. 28, 1993

[54] SPIRIT STOVE

[75] Inventor: Bengt E. O. Ebbeson, Ettenhausen, Switzerland

[73] Assignee: Aktiebolaget Electrolux, Sweden

[21] Appl. No.: 836,539

[22] Filed: Feb. 19, 1992

Related U.S. Application Data

[63] Continuation of Ser. No. 625,746, Dec. 11, 1990, abandoned.

[30] Foreign Application Priority Data

Dec. 12, 1989 [SE] Sweden ..... 8904175

[51] Int. Cl.[5] ..... F24C 5/00; F24C 5/14

[52] U.S. Cl. ..... 126/39 BA; 126/214 D; 126/214 R; 126/39 E; 126/39 K; 126/45; 126/43

[58] Field of Search ..... 126/39 E, 39 K, 39 H, 126/39 N, 39 J, 43, 44, 45, 46, 47, 48, 214 R, 220, 214 A, 214 B, 214 C, 214 D, 216

[56] References Cited

U.S. PATENT DOCUMENTS

| | | | |
|---|---|---|---|
| 156,503 | 11/1874 | Schreiber | 126/46 |
| 274,426 | 3/1883 | West | 126/50 |
| 1,716,329 | 6/1929 | Simpson | 126/39 BA |
| 1,887,855 | 11/1932 | Leety et al. | 126/44 X |
| 1,922,243 | 8/1933 | Herzmann | 126/220 |
| 2,019,604 | 11/1935 | Grieve . | |
| 2,075,108 | 3/1937 | Frick | 126/214 D X |
| 2,200,180 | 5/1940 | Kullberg | 126/44 X |
| 2,350,500 | 6/1944 | Eltz, Jr. | 126/214 C X |
| 3,470,862 | 10/1969 | Darrow et al. | 126/214 R X |
| 4,126,778 | 11/1978 | Cole | 126/214 R X |
| 4,748,967 | 6/1988 | Smith | 126/43 X |
| 4,899,723 | 2/1990 | Pajanes | 126/39 BA X |
| 4,957,096 | 9/1990 | Yokoyama | 126/214 D X |

FOREIGN PATENT DOCUMENTS

| | | | |
|---|---|---|---|
| 114261 | 4/1946 | Austria | 126/39 H |
| 18860 | 6/1913 | Denmark | 431/273 |
| 227206 | 10/1910 | Fed. Rep. of Germany | 126/43 |
| 284846 | 4/1931 | Italy | 126/44 |
| 595818 | 2/1978 | Switzerland | 126/43 |
| 190525 | 3/1935 | U.S.S.R. | 126/44 |
| 3715126 | 3/1988 | U.S.S.R. | 126/214 R |
| 4042 | of 1910 | United Kingdom | 126/43 |
| 200394 | 7/1923 | United Kingdom | 126/39 H |

*Primary Examiner*—Carl D. Price

*Attorney, Agent, or Firm*—Pearne, Gordon, McCoy & Granger

[57] ABSTRACT

This invention relates to a spirit stove. The spirit stove comprises a top (11) which is provided with at least one hot plate (15) of hear conducting material which is placed so that the plate joins the top. The stove has a spirit burner (33, 36, 37, 38) which is placed below the plate and to which air flows and from which fumes leave by natural ventilation. The plate is surrounded by a heat insulating material (23) having a surface which is exposed to the flames and/or the fumes.

7 Claims, 2 Drawing Sheets

SPIRIT STOVE

This is a continuation of application Ser. No. 07/625,746, filed Dec. 11, 1990 now abandoned.

BACKGROUND OF THE INVENTION

This invention relates to a spirit stove.

Such stoves are previously known and are preferably used as camping stoves, on yachts, in caravans and for other purposes where electricity and LP-gas are missing or are unsuitable for other reasons. For these stoves there are two types of burners, pressure burners, which are such burners where the fuel under pressure is distributed to several burner nozzles, and pressure free burners, where the fuel evaporates and burns from a free surface of the fuel container. Since the latter type of burner is a very simple construction, it has been widly used and the present invention relates to such a burner.

A drawback with the latter type of burner is that it creates a comparatively high, open flame. The existense of the flame causes, in addition to the risk of a fire, that the heat energy available is not used particularly effectively since spill heat dissipates and disappears beside the pan which is placed above the flame. In order to reduce the drawbacks mentioned above it is common to place a flame spreader, being shaped as a shield with or without holes, above the burner so that the flame is divided into several minor flames which also means a better air supply to the combustion process. This arrangement does not however change the situation with regard to the loss of heat energy by spill heat. A further drawback is that the pans being used become covered with soot from the flames.

It is also known to use camping stoves operating without open flames thus eliminating the soot covering problem. LP-gas or paraffin are, in such stoves, burnt below a ceramic top on which the pans are placed. These stoves are complicated since they demand pumps, fixed installations and so on in order to work properly.

Further there are camping stoves which are a combination of spirit burners and electrically heated stoves provided with a top, which is heated by electricity and which can be folded up in order to uncover a conventional spirit stove. These stoves are complicated and expensive.

SUMMARY OF THE INVENTION

The purpose of this invention is to achieve a simple spirit stove operating with a hidden flame thereby reducing the risk of setting fire to objects in proximity and eliminating the creation of soot on the pans and to utilize as much as possible of the energy content of the flames and the fumes. The spirit stove also has such a design that mainly no odor is created during burning of the spirit. Further the spirit stove operates with natural ventilation and without complicated means for directing fuel or air to the burner or for removing fumes from the burner. This is achieved because the device according to the invention has the characteristics mentioned in the claims.

BRIEF DESCRIPTION OF THE DRAWINGS

An embodiment of the invention will now be described with reference to the accompanying drawings in which FIG. 1 shows the front part of the stove as well as a vertical section through a spirit stove according to the invention whereas

DESCRIPTION OF THE PREFERRED EMBODIMENT

Figure 1:
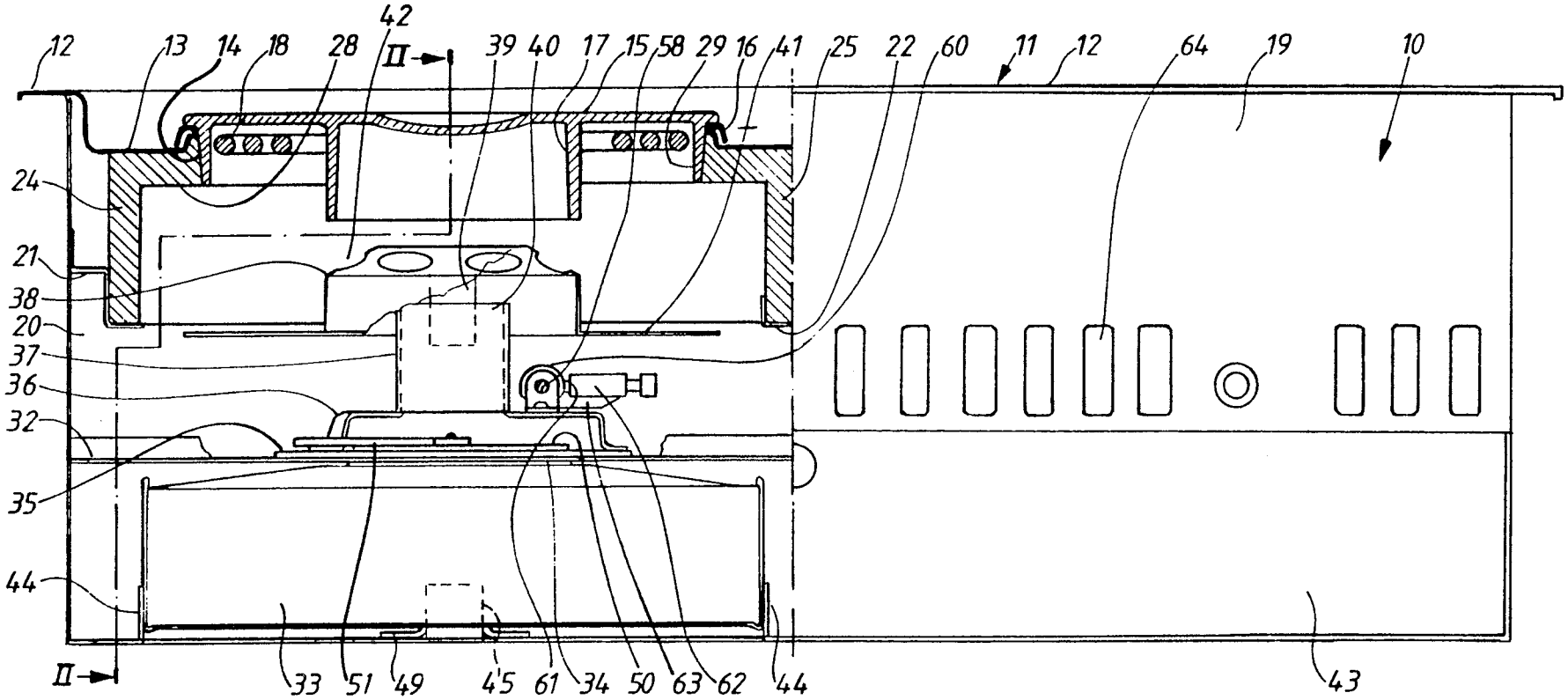
Figure 2:
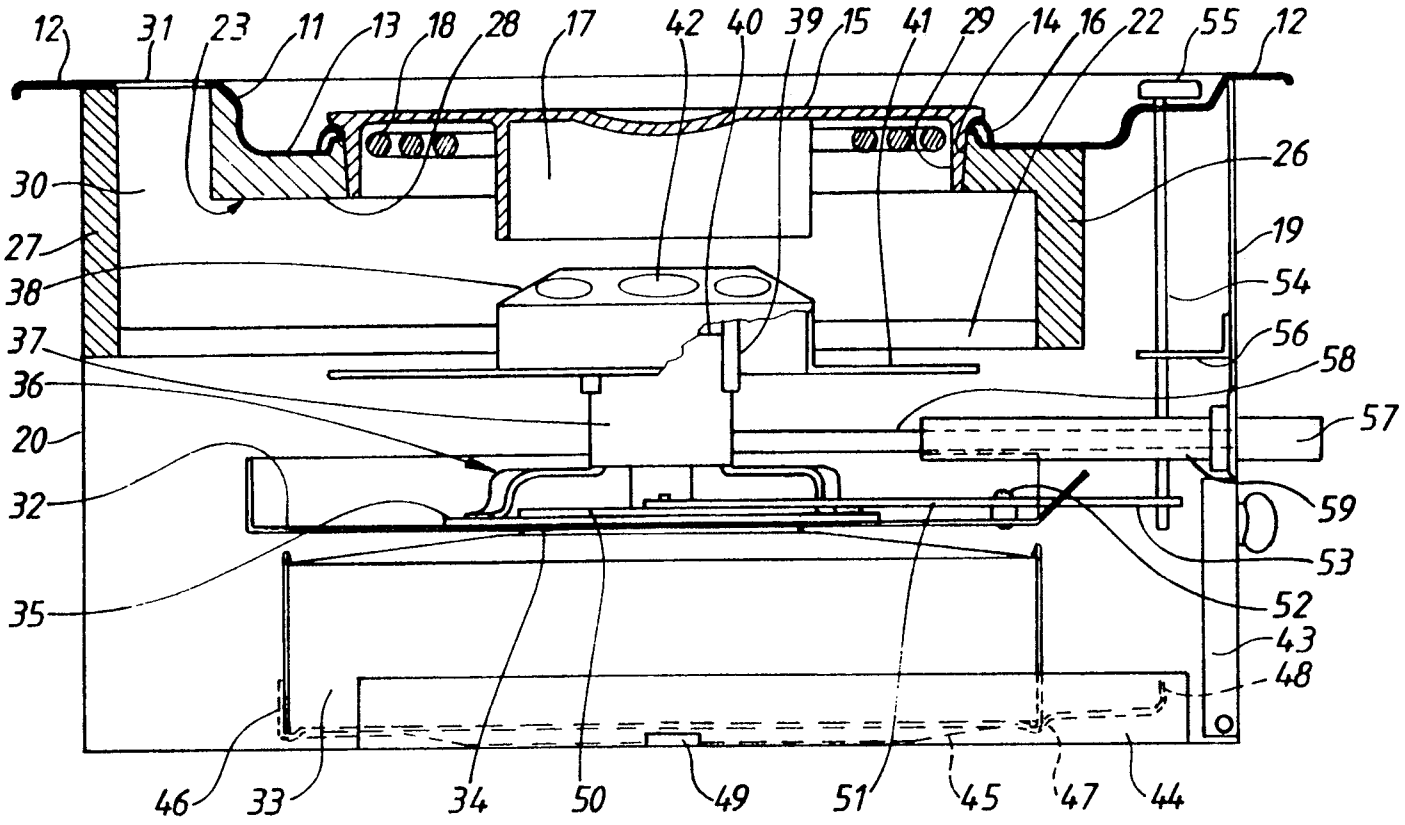
FIG. 2 is a vertical section on the line II—II in FIG. 1.

The Figures show a spirit stove for two hot plates which might differ from each other with respect to the size of the plates, the plates being placed on each side of the vertical middle line in FIG. 1. The invention can however be used for any number of plates. As appears from the Figures the stove comprises a box-like metal shell 10 the upper part of which is a top 11 having a higher edge part 12 and a lower central middle part 13. The top is preferably of stainless steel but can also be manufactured by other metals, ceramic materials, glass and so on and has an opening 14 for a hot plate 15 which is fastened to the top by means of a steel ring 16. The hot plate consists of a heat conducting material for instance cast iron and is at its bottom side provided with a projecting flange 17 which seen in a top view is U-shaped and directed so that the open part is directed towards the front. The bottom side also is provided with an electric coil 18 which is connected to an electric circuit, not shown, in the stove to be supplied from an electric source. Between the front and the rear wall 19 and 20, respectively of the shell 10 two profiles 21 and 22 are provided serving as supports for a heat insulating insert 23. This insert comprises two side walls 24 and 25 a front wall 26, a rear wall 27 and a roof part 28 surrounding an outer ring shaped, downwardly directed flange 29 of the plate 15. The insert further has a rear opening 30 which is placed below several outlet openings 31 at the rear edge part of the top.

The stove further has a horizontal heat protection plate 32 below which a fuel container 33 for the spirit is placed. The fuel container as usual comprises a closed circular metal shell enclosing a liquid absorbing mass. The upper central part of the container which is surrounded by a ring shaped flange 34, is open so that the mass with the absorbed spirit is uncovered. The flange 34 extends through a circular hole in the heat protection plate 32 so that the heat protection plate abuts the outer periphery of the flange.

On the heat protection plate 32 a ring 35 is fixed concentric with the flange 34 the ring supporting a part of the burner comprising a holder 36 with a burner tube 37. The holder comprises three S-shaped tongues applied about the ring 35 the tongues in their upper parts being joined to the burner tube which is directed vertically. The burner tube 37 supports a flame spreader 38 by means of a U-shaped metal plate 39 which is fastened to the upper part of the burner tube. The flame spreader is placed directly below the plate 15 and above the opening of the burner tube 40 and is shaped as a hat whose brim 41 is a heat reflecting part wheras the upper part of the hat has several holes 43 through which the flames are spread below the plate.

The spirit stove at its front wall 19 has a door 43 through which the fuel container can be removed in order to be filled. The container is guided sideways by profiles 44 fastened to the shell 10 and being supported by a spring metal plate 45 with a rear bend 46 and a front projection 47 and a front bend 48, the rear bend 46 and the projection 47 being a stop means for the container 33 so that it can be fastened on the metal plate 45. The front bend 48 serves as a handle by means of which the metal plate 45 and hence the container can be removed from the stove. The metal plate is guided by means of a yoke shaped holder 49 fastened to the bottom of the shell 10.

The ring shaped flange 34 of the container supports a circular control and extinguishing plate 50 which has a somewhat larger diameter than the outer diameter of the flange 34. The plate 50 can, by means of an, angular arm 51, seen in top view is fastened centrally at the plate, be moved continously from a position where it completely covers the opening within the ring shaped flange 34 to a position where the opening is completely uncovered. Thereby the plate is moved sideways between two of the tongues belonging to the holder 36. The arm 51 is fastened for turning motions about a vertical shaft 52 fastened to the front part of the heat protection plate and has a front end 53 with which a control lever being shaped as a bar 54 cooperates, the bar being provided with a control means 55 which is placed at the edge part 12 of the top 11 and which can be moved manually along the front edge of the stove. Since the control means is turnably and slidably secured to a flange 56 at the front part of the stove movement of the control means 55 causes a corresponding turning motion of the extinguishing plate 50.

The stove also comprises an ignition device consisting of a knob 57 at the front wall of the stove, the knob being secured to a shaft 58 which is turnably supported in a horizontal sleeve 59, the shaft supporting a notched wheel 60 at the burner tube. A spark creating pin 61 is pressed towards the wheel by means of a spring, not shown, which is fastened in a tube 62 the tube and shaft being supported by a bracket 63 secured to the holder 36.

Above the door 43 there are several air-inlet openings 64 at the front side of the stove.

The spirit stove operates in the following way. Provided that there is fuel in the container 33 this fuel can be ignited by turning the knob 57. A spark is created by the motion between the notched wheel 60 and the pin 61. This spark falls down into the opening within the annular flange 34 of the container 33 provided the extinguishing plate has been removed by means of the control means 55. The fuel is ignited and combustion air is thereby sucked through the openings 64 and through the holder 36 into the burner tube 37 whereby flames blow up through the holes 42 of the flame spreader 38. Secondary air at the same time enters freely through the air-inlet openings 64 to all parts of the flames around the burner tube 27 and to the area between the flame spreader 38 and the hot plate 15 or the insert 23. By acting on the control means 55 the size of the flame can be controlled. Because of the existense of the flange 17 the hot fumes are first directed forward below the hot plate 15 after which they are deflected rearward about the front edges of the flange 17 and flow between the outside of the flange 17 and the flange 29 and the insert 23 towards the rear edge of the hot plate where the fumes leave through the opening 30 of the insert and further through the outlet openings 31 of the top. The purpose of the insert 23 is to prevent heat from the flames from being transmitted to the top and to concentrate the heat energy from the flames to the hot plate. It has turned out that when the heat insulating material in the insert has reached a certain temperature and the heat transmission between the flames and the surrounding insert decreases the flames are deflected towards the bottom side of the hot plate thereby increasing the heat exchange with it.

I claim:

1. A spirit stove comprising a top surface (11) including at least one hot plate (15) of heat conducting material, said plate being adapted to directly support an object to be heated and having a generally circular flange (17) extending downwardly from a central portion of the underside of said plate, said flange having an opening therein, a spirit burner (33, 36, 37, 38) located below the plate such that air flows to the burner and combustion fumes flow away from the burner by natural ventilation, and a heat insulating material (24, 25) exposed to flames generated by said burner, said insulating material extending below and surrounding the plate (15) and flange, a duct being formed between said flange and said heat insulating material for directing combustion fumes away from said hot plate underside to and through an exhaust channel (30) defined by the insulating material to an outlet (31) which is spaced from said plate, wherein flames from said burner do not contact and are isolated from the object to be heated on the hot plate, said flange opening being spaced from said exhaust channel with a portion of said flange being located between said exhaust channel and said flange opening wherein said combustion fumes flow away from said exhaust channel, out of said opening, through said duct, toward and through said channel, and then out of said outlet, wherein heat transfer between said combustion fumes and the underside of said hot plate is maximized.

2. A spirit stove according to claim 1, characterized in that the outlet (31) for the fumes is located at a rear edge of the top surface (11).

3. A spirit stove according to claim 1, characterized in that the hot plate (15) at its bottom side has a electric heating coil (18).

4. A spirit stove according to claim 3, characterized in that the heating coil is located at a distance from the bottom side of the hot plate (15).

5. A spirit stove according to claim 1, characterized in that the top surface (11) consists of stainless steel.

6. A spirit stove according to claim 1, characterized in that a spark creating means which is accessible outside of the stove is located in proximity to a fuel container (33) being a part of the burner.

7. A spirit stove according to claim 6, characterized in that spark creating means comprises a notched wheel (60) and a pin (61) abutting the wheel.

* * * * *

UNITED STATES PATENT AND TRADEMARK OFFICE

CERTIFICATE OF CORRECTION

PATENT NO. : 5,273,023

DATED : December 28, 1993

INVENTOR(S) : Bengt E. O. Ebbeson

It is certified that error appears in the above-identified patent and that said Letters Patent is hereby corrected as shown below:

On the title page, item (57) Abstract, line 13, delete "hear" and insert --heat--.

Column 2, line 56, delete "43" and insert --42--.

Column 3, line 6, delete "," (comma, second occurrence); and line 7, after "view" insert --,-- (comma).

Column 4, line 36, (Claim 1, line 25), after "said" insert --exhaust--.

Signed and Sealed this

Nineteenth Day of July, 1994

*Attest:*

Bruce Lehman

BRUCE LEHMAN

*Attesting Officer*

*Commissioner of Patents and Trademarks*